United States Patent [19]

Micallef

[11] 4,138,039

[45] Feb. 6, 1979

[54] PUMP ACTUATING SYSTEM

[75] Inventor: Lewis A. Micallef, Fort Lee, N.J.

[73] Assignee: Leeds and Micallef, Fort Lee, N.J.

[21] Appl. No.: 728,930

[22] Filed: Oct. 4, 1976

[51] Int. Cl.[2] ..... B05B 11/02

[52] U.S. Cl. ..... 222/321; 222/509

[58] Field of Search ..... 222/321, 509, 402, 13

[56] References Cited

U.S. PATENT DOCUMENTS

| | | | |
|---|---|---|---|
| 3,409,186 | 11/1968 | Melocchi | 222/402.13 |
| 3,452,905 | 7/1969 | Micallef | 222/321 X |
| 3,608,784 | 9/1971 | Brown et al. | 222/509 X |
| 4,011,970 | 3/1977 | Crowle et al. | 222/321 |

*Primary Examiner*—Robert B. Reeves
*Assistant Examiner*—John P. Shannon
*Attorney, Agent, or Firm*—Kane, Dalsimer, Kane, Sullivan and Kurucz

[57] ABSTRACT

A pump actuating system is associated with a container having a pump for dispensing the container contents. The system includes a housing mounted on the neck of the container and at the same time the housing serves to couple the pump with the outlet end of the container. The pump is of the reciprocal type having a reciprocating plunger which also serves to direct the container contents away from the pump. A conduit couples with the pump outlet and serves to direct the pumped container contents either coaxially with or transversely of the axis of the neck of the container in accordance with the selected dispensing pattern. An actuator is mounted by the housing and is coupled with the conduit for facilitating the actuation of the pump between a first pump position at which the container contents are drawn into the pump chamber and a second position at which the contents are expelled therefrom. The actuator is integrally molded so as to include a trigger, toggle and guides. The trigger is shiftable along an axis normal to the axis of the pump plunger which movement is facilitated by the guides. The toggle includes a substantially planar intermediate section that includes a hinge that permits the intermediate planar sections to fold the sections about the hinge towards one another whereby the transverse movement of the actuator is translated into reciprocal movement of the plunger and consequently actuation of the pump from its first pump position to its second position at which the container contents are expelled from the pump chamber. Release of the actuator permits the intermediate toggle sections to unfold away from one another by the hinge means to cause reverse reciprocation of the plunger and consequent actuation of the pump to its initial position at which the pump chamber is filled with the material to be pumped.

19 Claims, 6 Drawing Figures

PUMP ACTUATING SYSTEM

BACKGROUND OF THE INVENTION

Fluid dispensing pumps for containers have been gaining in popularity and success and in particular plunger actuated pumps are now handling a wide variety of products marketed in the cosmetic, toiletry, food and household product fields. However, the vertical finger actuated plunger type of pump possesses several inherent disadvantages, drawbacks and inconveniences in regard to the dispensing of cosmetics, deodorants and perfumes.

Within the recent past there has developed an increasing need and demand for trigger actuated pumps. An example of a pump of this type that has proven to be eminently successful is disclosed in U.S. Pat. No. 3,749,290 granted July 31, 1973.

Needless to say, there is always a need for different pumps, but pumps of superior construction and efficient performance that are of relatively simple design and construction and costs that are not only comparable but preferably lower in cost, construction, manufacture and assembly.

SUMMARY OF THE INVENTION

It is, accordingly, among the principal objects of the present invention to provide a pump actuating system that is adapted to be associated with reciprocating plunger actuated dispensing pumps that permits the pump to be actuated in a more convenient and expeditions manner that is more conductive to the dispensing pattern selected.

Another object is to provide a pump actuating system of the foregoing type which permits vertical or coaxially dispensing of the container products in consequence of lateral actuation of a button or trigger; and consequently a pump actuating system that lends itself to more convenient dispensing of cosmetics such as deodorants and perfumes then heretofore possible by commercially available plunger type pumps.

A further object is to provide a pump actuating system that renders it possible to convert plunger actuated dispensing pumps into trigger pumps by translating lateral movement of the actuating system into vertical reciprocal movement of the plunger.

DETAILED DESCRIPTION OF THE PREFERRED EMBODIMENT

Figure 2:
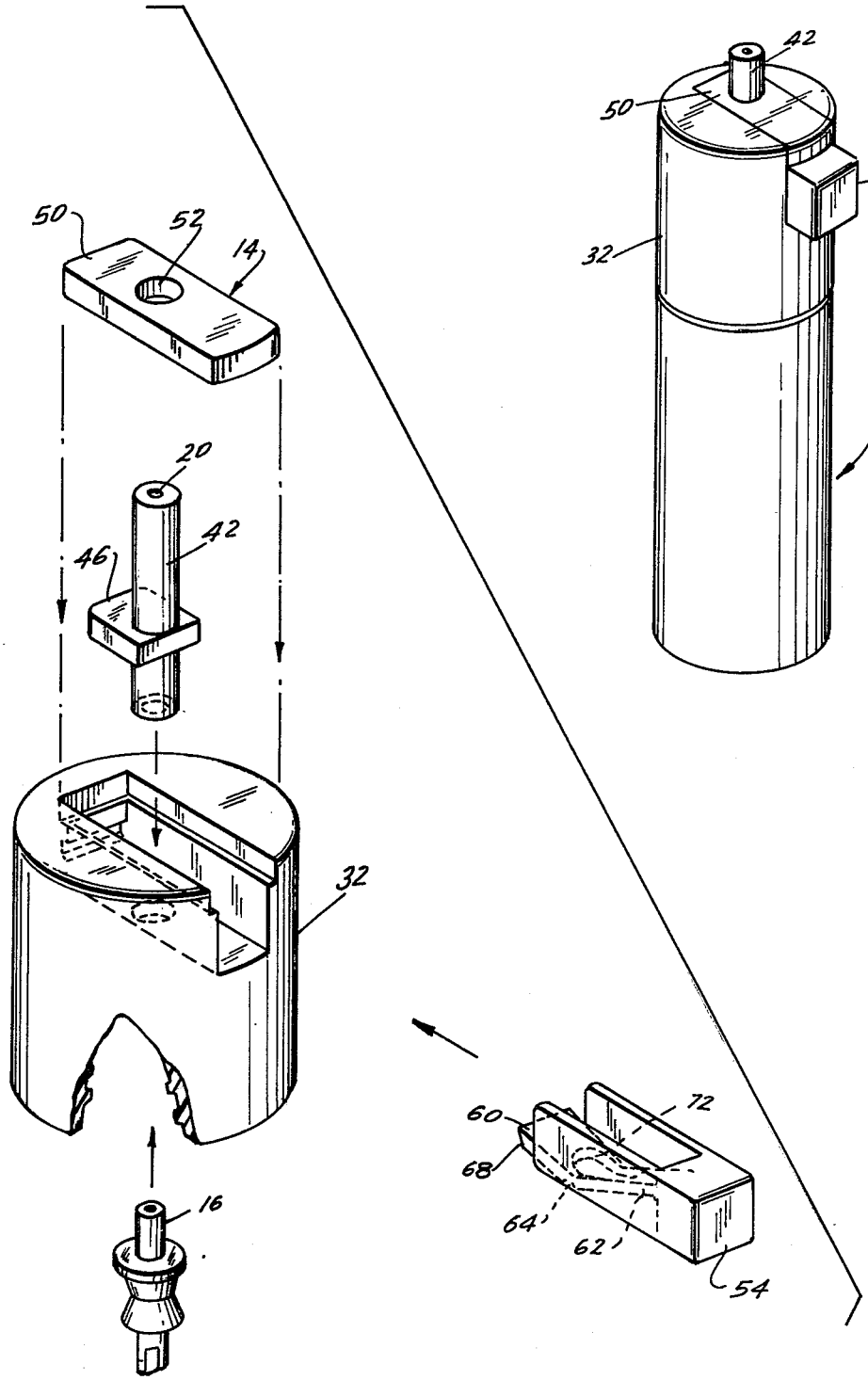
FIG. 2 is an exploded perspective view of the pump actuating system with the pump plunger only fragmentarily shown.
Figure 1:
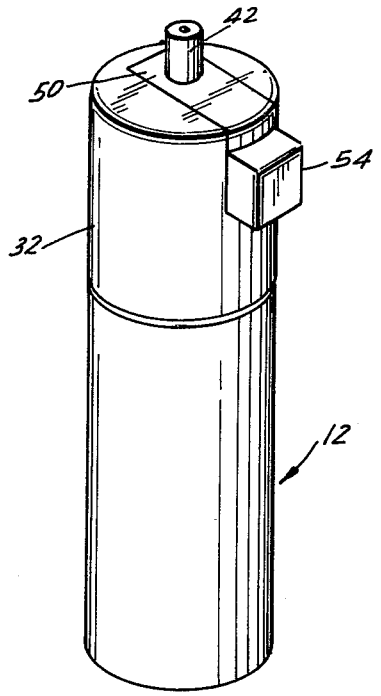
FIG. 1 is a perspective view of the pump actuating system of the present invention associated with the neck of a container having a plunger to a reciprocating pump.

In the drawings, the reciprocating plunger actuator disensing pump 10 is shown disposed along the opening of a container 12 and is adapted to be conveniently and advantageously actuated by the pump actuating system 14 of this invention. The container 12 may assume the form of any conventional or commercial bottle or similar receptacle, made of glass, plastic or other suitable materials. The container may be used for holding and dispensing a wide variety of materials generally in liquid form as may be found on the markets today. These materials may possess different degrees of viscosity and may include oil, perfume or the like or pasty substances such as creams or the like. In the illustrated embodiment a cosmetic version of the invention is shown having particular application to deodorants and perfumes. It should be understood however, that the present invention is also suitable for household use, room deodorants and the like. As will be readily understood by those skilled in the art suitable modifications can be made to adapt the present invention to lotions and the discharge pattern can be directed at any angle for direction.

Figure 5:
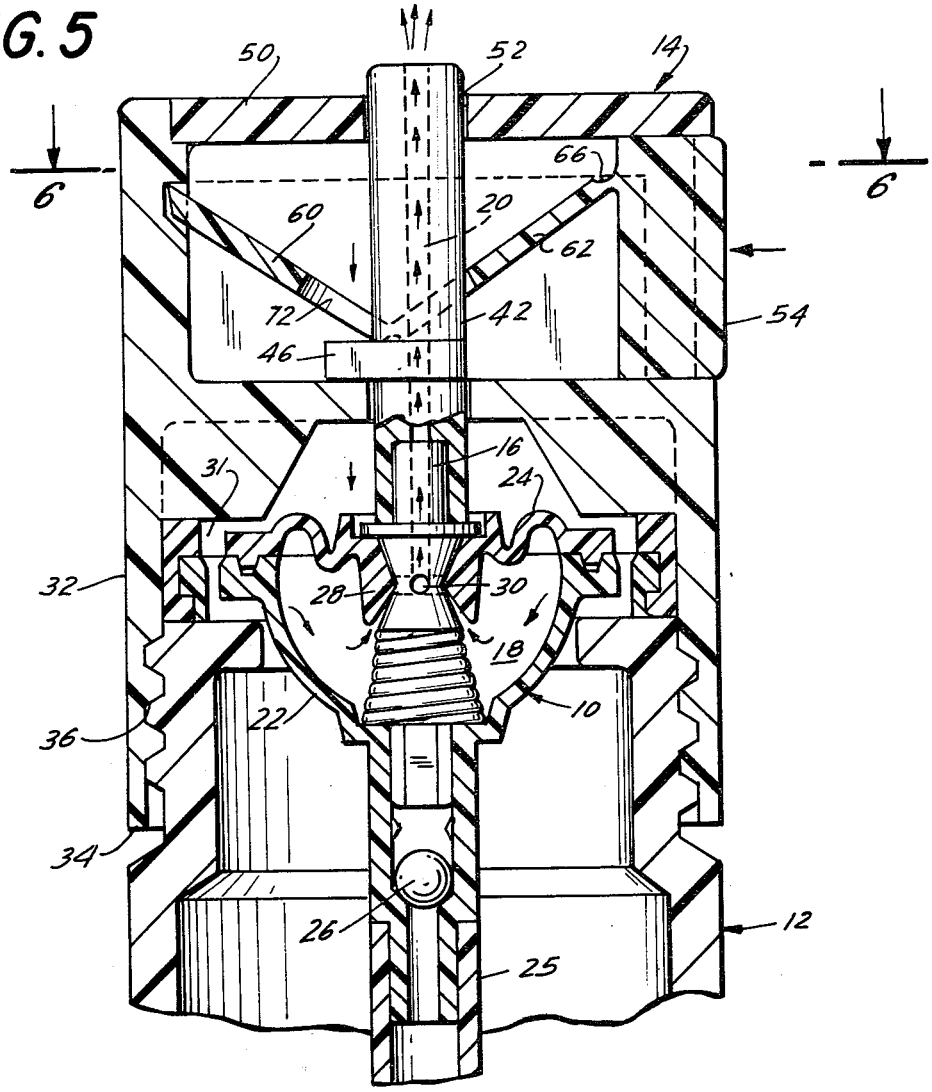
FIG. 5 is a view similar to FIG. 3 with the actuating system shown in the process of actuating the pump to cause the expelling of material from the pump chamber.

The pump 10 may assume the form of any known or commercially available vertically reciprocating plunger actuated pumps; and in this connection it may be a mechanical piston pump or elastomeric diaphragm pump 24. The illustrated exemplary pump 10 is disclosed in detail in U.S. Pat. No. 3,452,905 granted July 1, 1969 and for a better understanding of the construction and operation of this pump reference should be made to that patent. Suffice it to say, that upon downward vertical reciprocation of the plunger 16, subsequent to the priming of the pump 10, the material to be dispensed from the container 12 that is disposed in the pump chamber 18 will be expelled out through the plunger orifice 20. (See FIG. 5) Upon upward vertical reciprocation of the plunger 16, material within the container will be drawn into the pump chamber 18 to complete the pumping cycle.

Towards this end, the pump will include a relatively rigid base adapted to be supported across the opening of the neck of the container 12. The base 22 includes a lower opening which couples with a dip tube 25 in order that material within the container 12 may be pumped into the pump chamber 18. A check valve 26 closes the opening in the lower part of the base 22 and is closed during the dispensing of the material from the chamber 12 and is unseated to provide communication between the base opening and the material to be dispersed in the container. A relatively flexible and elastomeric diaphragm 24 has peripheral portions thereof and fluid tight engagement with the associated peripheral portions of the base 22. The diaphragm 24 is provided with a downwardly depending central boss 28 that defines a central opening. The plunger 16 has a lateral opening 30 that is adated to permit communication of the plunger passage 20 and the pump chamber 18. Surfaces of the plunger adjacent this opening 30 and associated surfaces of the boss 28 define a second valve for sealing the plunger opening during the filling of the pump chamber and for opening the plunger opening during the dispensing of the material to be dispensed from the pump chamber 18. The boss 28 is provided with a double cone configuration and the associated surfaces of the plunger 16 are similarly structured as shown in the drawings. Air network 32 permits the passage of air from the ambient into the container to replace the volume of the material to be dispensed which is drawn from the container interior into the pump chamber 18.

In operation, the plunger 16 is depressed to move the diaphragm 24, towards the base 22 to reduce the volume of the pump chamber 18 thereby pressurizing the material in the chamber. At the same time the upper valve defined by the interengaging surfaces of the boss 28 and plunger 16 is caused to open whereupon the material in the pump chamber is adapted to flow into the plunger passage 20. When the diaphragm 24 is moved in the opposite direction away from the base 22, upon retraction of the plunger, causes an increase in volume of the pump chamber 18. At the same time, the plunger opening 30 is closed by the boss 28 and the lower check valve 26 is opened to permit material in the container to enter the pump chamber 18. When the retraction of the plunger 16 is completed the lower valve 26 closes. The pump is now ready for its next pumping cycle.

The pump actuating system 14 facilitates the vertical reciprocation of the plunger 16 and consequently the actuation of the pump 10. The housing 32 forms a part of this system and also serves as a cap for both the pump 10 and the neck of the container 12. Towards this end, the lower end 34 of the cap includes internal threads 36 which mate with corresponding threads appearing on the neck of the container. Obviously other means of connecting these two parts are contemplated depending on the neck finish. In a somewhat similar fashion to that disclosed in the above-referenced patent, the cap 32 will include a transverse partition 38 having a central hole 40 which retains pump 10 in place and cooperates therewith in assuring proper pump function. The hole 40 conveniently receives therethrough plunger 16 and associated structure of the pump actuating system 14. In this connection, the pump actuating system 14 includes stem extension 42 coupled in any suitable fashion to the plunger 16. At the stem extension upper end a suitable nozzle 44 is present to provide a selected discharge pattern. The nozzle 44 may be integrally formed with the stem extension or be a separate unit as is well known to the trade. Furthermore the nozzle 44 as well as the stem extension 42 may be changed to dispense at any selected angle or direction such as the lateral direction as contemplated in U.S. Pat. No. 3,749,290 granted July 31, 1973 and with a discharge pattern of the type contemplated by U.S. Pat. No. 3,843,030 granted on Oct. 22, 1974. The stem extension 42 is also provided with a laterally extending flange 46 which serves as a coupling means for toggle 48 and the stem extension 42 to facilitate the actuation of the pump 10. At the top of the cap 32 appears a cover 50 having a opening 52 which serves as an upper stem extension guide. this cover may be cemented, press fit or otherwise secured in place and as will be evident shortly also serves as a guide for the toggle 48.

The toggle 48 through its coupling with the flange 46 serves to translate lateral or horizontal motion into vertical or reciprocating motion of the stem extension 42, the plunger 16 and consequently the operation of the pump 10. For such purposes, one end of the toggle 48 includes a finger engaging actuator or button 54 which serves as a trigger which may be engaged and actuated by any finger including the thumb or forefinger. Extending inwardly from the trigger 54 are a pair of flanges 56 and 58 which serve as guides which are disposed between and engage with surfaces of the cover 50 and partition 38 to assure proper lateral movement of the trigger 54 and operation of the pump actuating system 14. The toggle 48 further includes two sections 60 and 62 of substantially planar configuration that are integrally and hingedly connected to one another by hinge 64. Section 62 is hingedly connected to the trigger 54 by hinge 66 while the free end 68 of section 60 is disposed in an accommodating recess 70 or otherwise secured to the adjacent surfaces of the cap 32. An elongated slot 72 extends into both sections 60 and 62 for reception of the stem extension 42 and non-interference with the operation of the toggle 48 and the vertical reciprocation of the stem extension 42.

Figure 3:
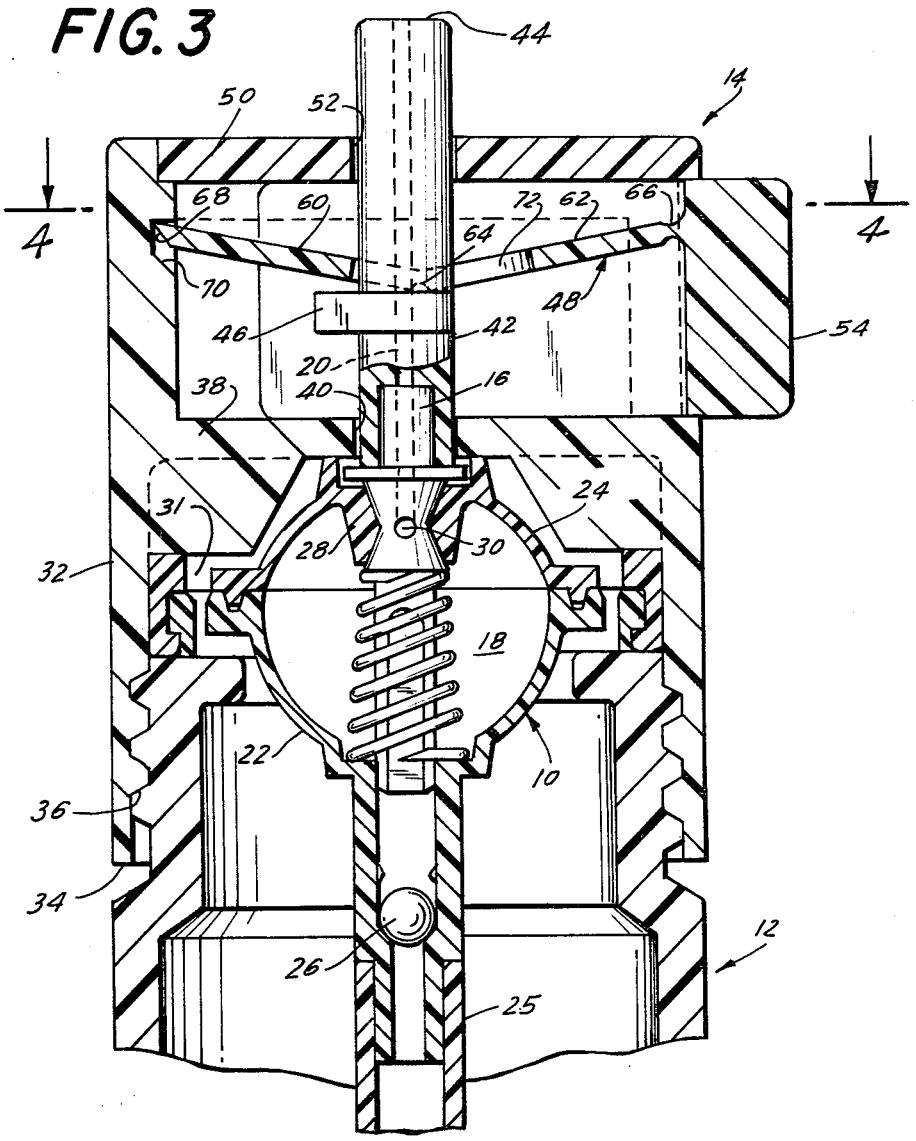
FIG. 3 is an enlarged longitudinal sectional view of the pump actuating system as well as an exemplary plunger actuator reciprocating pump both associated with the neck of a container which is only fragmentarily shown.
Figure 4:
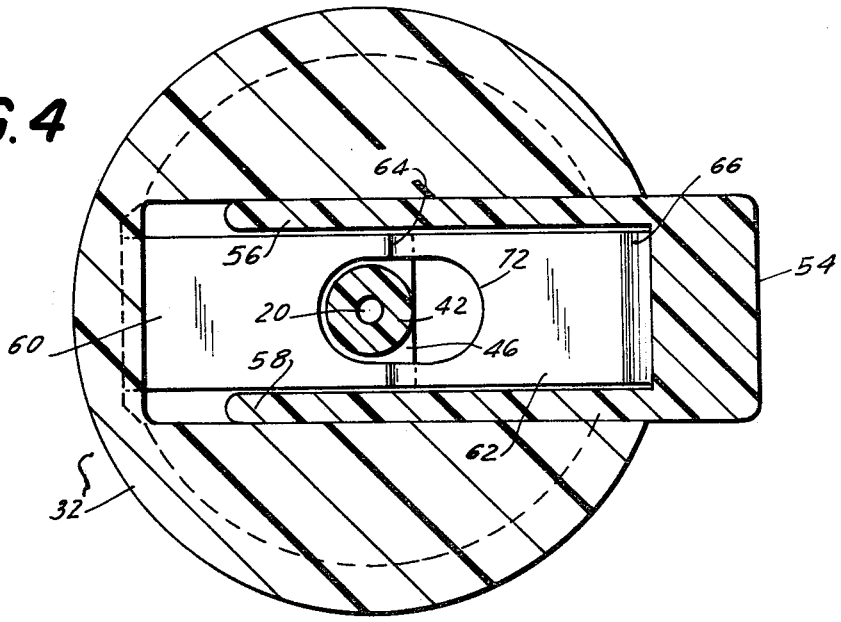
FIG. 4 is a cross-sectional view taken along the line 4—4 of FIG. 3.
Figure 6:
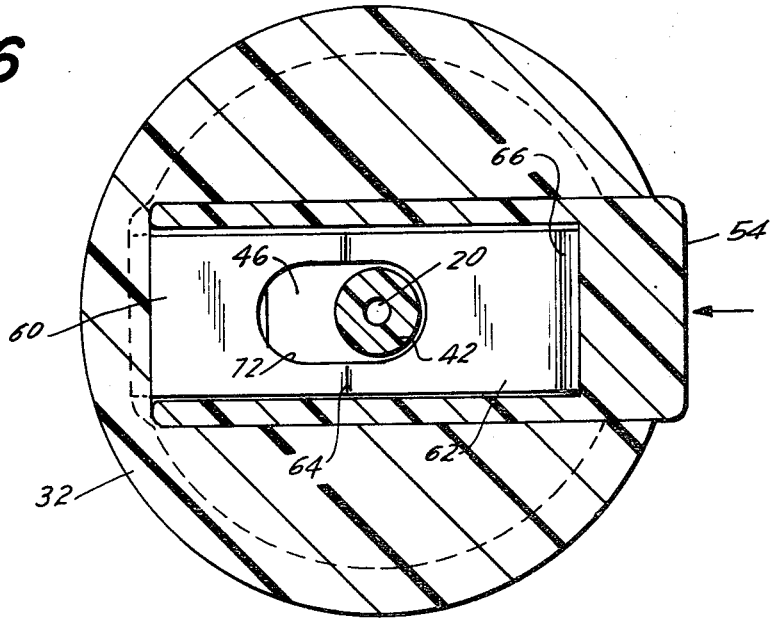
FIG. 6 is a cross-sectional view taken along the line 6—6 of FIG. 5.

In operation, the pump will initially assume its "at rest" position as shown in FIGS. 3 and 4 with the toggle sections 60 and 62 slightly flexed downwardly to avoid locking of the sections. In this position it will be assumed that the pump is primed with material to be dispensed in the pump chamber 18 and the plunger 15 and its coupled stem extension 42 in their respective uppermost extended positions. When it is desired to dispense the container product the trigger 54 is engaged and by suitably applied finger pressure is moved horizontally or inwardly as the case may be to the disposition of parts shown in FIGS. 5 and 6 during which movement the material in the pump chamber 18 is dispensed out through the nozzle 44. Towards this end, the toggle sections 60 and 62 will pivot towards one another about the hinge 64 and in so doing and through the engagement of the sections with flange 46 will shift the plunger extension downwardly to reciprocate the plunger 16 in a downward direction to cause reduction of the pump chamber 18 and consequent discharge of the material therein. Upon release of the trigger 54 the reverse action takes place, with the plunger 16 and coupled stem extension 42 being shifted upwardly and the toggle 48 returned to its "at rest" position. During this movement, material in the container 12 will be drawn into the pump chamber 18 for the next pumping stroke. In this connection, the pump actuating system 14 and particularly the toggle 48 need only be actuated in a similar manner to cause further reciprocation in a vertical direction of the plunger 16 and consequent operation of the pump 10.

Although several somewhat preferred embodiments of the invention have been disclosed and described in detail herein, it should be understood that this invention is in no sense limited thereby and its scope is to be determined by that of the appended claims.

What is claimed is:

1. A pump actuating system for a container having a pump for dispensing the container contents, the pump being a reciprocating pump having a vertically reciprocating plunger having a discharge outlet, the system comprising:

a housing, the housing being a cap having means for coupling with the neck of a container;

conduit means at the outlet of the pump to direct the contents of the container away from the pump, the conduit means including a separate nozzle coupled with the outlet of the pump for directing the container contents in a preselected dispensing pattern;

an acuator means mounted by the housing for actuating the pump from a first pump position at which the container contents are in the pump chamber to a second pump position at which the contents are expelled from the pump chamber and then back to the first pump position at which the contents are drawn into the pump chamber;

the actuator means being shiftable in a direction transverse of the conduit means from a first actuator position at which the pump is at the first pump position to a second actuator position at which the pump is actuated to the second pump position and then back to the first actuator position at which the pump is returned to the first pump position, the transverse direction along which the actuator means is shiftable being substantially horizontal, and the actuator means translating its horizontal movement into vertical reciprocation of the conduit means and consequently actuation of the pump; and the actuator means comprising a single transverse force applying member coupled with the plunger in a manner whereby friction forces are minimal and the forces applied will produce minimum torque during shifting of the actuator means and reciprocation of the plunger.

2. The invention in accordance with claim 1, wherein a dispensing pump for use in incorporation on a container for the material to be dispensed is associated with the pump actuating system, the dispensing pump comprising in combination:

a relatively rigid base member adapted to be supported across the opening of a container, said member having an opening and means for communicating said opening with the material to be dispensed first valve means for closing the opening during the dispensing of said material and unseating to provide communication between the opening and the material to be dispensed in the container;

a relatively flexible diaphragm having peripheral portions thereof in fluid-tight engagement with associated peripheral portions of the base member, said diaphragm including a central boss defining a central opening;

a reciprocating plunger extending into the central opening of the diaphragm, said plunger having surfaces cooperable with associated surfaces of the diaphragm boss in providing means for attaching the plunger to the diaphragm for permitting flexing of the diaphragm upon reciprocation of the plunger, the plunger having an interior passage for the dispensing of the material to be dispensed, said plunger and said base member and said diaphragm cooperating with one another in defining a pump chamber for containing the material to be dispensed, the plunger having an opening communicating with the plunger passage and adapted to communicate with the pump chamber for permitting flow of the material from the pump chamber into the plunger passage, surfaces of the plunger adjacent the plunger opening and associated surfaces of the boss defining a second valve means for sealing the plunger opening during filling of the pump chamber and for opening the plunger opening during the dispensing of the material to be dispensed from the pump chamber into the plunger passage;

air network means for permitting the passage of air from the ambient into the container to replenish the volume of the material to be dispensed which is drawn from the container interior into the pump chamber;

the diaphragm when moved by the plunger in one direction, for pumping, towards the base member being adapted to reduce the volume of the pump chamber thereby pressurizing the material to be dispensed in the pump chamber and at the same time causing the second valve means to open the plunger opening whereupon the material in the pump chamber is adapted to flow into the plunger passage and be dispensed therefrom; and the diaphragm when moved in the opposite direction away from the base member upon retraction of the plunger increasing the volume of the pump chamber and closing the plunger opening by the second valve means and causing the unseating of the first valve means to open the base member opening to the material to be dispensed in the container thereby permitting the material to be dispensed in the container to enter the pump chamber with the first valve means closing the base member opening upon termination of the retraction of the plunger and flexing of the diaphragm away from the base member as well as during pumping and dispensing of the material to be dispensed.

3. The invention in accordance with claim 2 wherein the diaphragm boss includes a double cone surface defining the central opening of the diaphragm, the upper portion of the double cone surface being a substantially inverted truncated cone associated with a complementary shaped conical surface of the plunger for providing said connection means and the lower portion of the double cone surface defining an upright truncated cone in association with a complementary shaped cone forming part of the plunger in providing said second valve means.

4. A pump actuating system for a container having a pump for dispensing the container contents comprising:

a housing;

conduit means at the outlet of the pump to direct the contents of the container away from the pump;

an actuator means mounted by the housing for actuating the pump from a first pump position at which the container contents are in the pump chamber to a second pump position at which the contents are expelled from the pump chamber and then back to the first pump position at which the contents are drawn into the pump chamber, the conduit means extending through the actuator means;

the actuator means being shiftable in a direction transverse of the conduit means from a first actuator position at which the pump is at the first pump position to a second actuator position at which the pump is actuated to the second pump position and then back to the first actuator position at which the pump is returned to the first pump position;

the actuator means including a coupling means for coupling with the conduit means for causing actuation of the pump upon shifting of the actuating means, a finger actuated toggle having a fixed end fixedly connected to the housing, a distal toggle end having a finger engaging means for shifting the actuator means for actuating the pump and hinge means intermediate the toggle ends for translating the shifting of the finger engaging means into movement of the conduit means through the coupling means that causes actuation of the pump.

5. The invention in accordance with claim 4, wherein the pump is a reciprocating pump having a vertically reciprocal plunger having a discharge outlet.

6. The invention in accordance with claim 4, wherein the transverse direction along which the actuator means is shiftable is substantially horizontal, and the actuator means translates its horizontal movement into vertical reciprocation of the conduit means and consequently actuation of the pump.

7. The invention in accordance with claim 4 wherein the conduit means includes a separate nozzle coupled with the outlet of the pump for directing the container contents in a preselected dispensing pattern.

8. The invention in accordance with claim 4, wherein the toggle includes guide means for guiding the movement of the toggle through an accommodating slot of the housing.

9. The invention in accordance with claim 4, wherein the toggle is flexed about the hinge means away from its planar position to avoid locking of the toggle when in the first actuator position.

10. The invention in accordance with claim 4, wherein the toggle includes a pair of sections interconnected by the hinge means.

11. A pump actuating system for a container having a pump for dispensing the container contents comprising:

a housing, the housing being a cap having means for coupling with the neck of a container;

conduit means at the outlet of the pump to direct the contents of the container away from the pump;

an actuator means mounted by the housing for actuating the pump from a first pump position at which the container contents are in the pump chamber to a second pump position at which the contents are expelled from the pump chamber and then back to the first pump position at which the contents are drawn into the pump chamber;

the actuator means being shiftable in a direction transverse of the conduit means from a first actuator position at which the pump is at the first pump position to a second actuator position at which the pump is actuated to the second pump position and then back to the first actuator position at which the pump is returned to the first pump position;

the actuator means including a coupling means for coupling with the conduit means for causing actuation of the pump upon shifting of the actuating means, a finger actuated toggle having a fixed end fixedly connected to the housing, a distal toggle end having a finger engaging means for shifting the actuator means for actuating the pump and hinge means intermediate the toggle ends for translating the shifting of the finger engaging means into movement of the conduit means through the coupling means that causes actuation of the pump.

12. A pump actuating system for a container having a pump for dispensing the container contents comprising:

a housing;

conduit means at the outlet of the pump to direct the contents of the container away from the pump;

an actuator means mounted by the housing for actuating the pump from a first pump position at which the container contents are in the pump chamber to a second pump position at which the contents are expelled from the pump chamber and then back to the first pump position at which the contents are drawn into the pump chamber;

the actuator meeans being shiftable in a direction transverse of the conduit means from a first actuator position at which the pump is at the first pump position to a second actutor position at which the pump is actuated to the second pump position and then back to the first actuator position at which the pump is returned to the first pump position;

the actuator means including coupling means for coupling with the conduit means for causing actuation of the pump upon shifting of the actuating means, a finger actuated toggle having a fixed end fixedly connected to the housing, a distal toggle end having a finger engaging means for shifting the actuator means for actuating the pump and hinge means intermediate the toggle ends for translating the shifting of the finger engaging means into movement of the conduit means through the coupling means that causes actuation of the pump;

the pump being a reciprocating pump having a vertically reciprocating plunger having a discharge outlet wherein the finger engaging means is shiftable along an axis normal to the axis of the plunger and the toggle includes substantially planar intermediate toggle sections that include the hinge means whereupon movement of the finger engaging means causes the intermediate planar toggle sections to fold and move towards one another about the hinge means thereby causing the hinge means to shift downwardly and consequently shift the coupling means downwardly to force the pump into the second pump position and release of the finger engaging means causes the intermediate toggle sections to unfold away from one another about the hinge means to cause the hinge means to shift vertically to cause the plunger to shift correspondingly in a vertical direction to cause the pump to move to the first pump position.

13. A pump actuating system for a container having a pump for dispensing the container contents comprising:

a housing;

conduit means at the outlet of the pump to direct the contents of the container away from the pump;

an actuator means mounted by the housing for actuating the pump from a first pump position at which the container contents are in the pump chamber to a second pump position at which the contents are expelled from the pump chamber and then back to the first pump position at which the contents are drawn into the pump chamber;

the actuator means being shiftable in a direction transverse of the conduit means from a first actuator position at which the pump is at the first pump position to a second actuator position at which the pump is actuated to the second pump position and then back to the first actuator position at which the pump is returned to the first pump position;

the actuator means including coupling means for coupling with the conduit means for causing actuation of the pump upon shifting of the actuating means, a finger actuated toggle having a fixed end fixedly connected to the housing, a distal toggle end having a finger engaging means for shifting the actuator means for actuating the pump and hinge means intermediate the toggle ends for translating the shifting of the finger engaging means into movement of the conduit means through the coupling means that causes actuation of the pump;

the toggle including guide means for guiding the movement of the toggle through an accommodating slot of the housing, the toggle is flexed about the hinge means away from its planar position to avoid locking of the toggle when in the first actuator position, the pump is a reciprocating pump having a vertically reciprocating plunger having a discharge outlet wherein the finger engaging means is shiftable along an axis normal to the axis of the plunger and the toggle includes substantially planar intermediate toggle sections that include the hinge means whereupon movement of the finger engaging means causes the intermediate planar toggle sections to fold and move towards one another about the hinge means thereby causing the hinge means to shift downwardly and consequently shift the coupling means downwardly to force the pump into the second pump position and release of the finger engaging means causes the intermediate toggle sections to unfold away from one another about the hinge means to cause the hinge means to shift vertically to cause the plunger to shift correspondingly in a vertical direction to cause the pump to move to the first pump position.

14. A pump actuating system for a container having a pump for dispensing the container contents comprising:

a housing;

conduit means at the outlet of the pump to direct the contents of the container away from the pump;

an actuator means mounted by the housing for actuating the pump from a first pump position at which the container contents are in the pump chamber to a second pump position at which the contents are expelled from the pump chamber and then back to the first pump position at which the contents are drawn into the pump chamber;

the actuator means being shiftable in a direction transverse of the conduit means from a first actuator position at which the pump is at the first pump position to a second actuator position at which the pump is actuated to the second pump position and then back to the first actuator position at which the pump is returned to the first pump position;

the actuator means including coupling means for coupling with the conduit means for causing actuation of the pump upon shifting of the actuating means, a finger actuated toggle having a fixed end fixedly connected to the housing, a distal toggle end having a finger engaging means for shifting the actuator means for actuating the pump and hinge means intermediate the toggle ends for translating the shifting of the finger engaging means into movement of the conduit means through the coupling means that causes actuation of the pump, the toggle including guide means for guiding the movement of the toggle through an accommodating slot of the housing;

the housing cooperating in defining a pair of spaced accommodating guide recesses forming part of the accommodating slot of the housing and disposed on each side of the conduit means, the guide means including a pair of spaced flanges extending from the finger engaging means and being disposed in the recesses on each side of the conduit means.

15. The invention in accordance with claim 14, wherein the toggle includes a pair of sections interconnected by the hinge means and being interposed between the pair of spaced flanges with one of the sections extending from the finger engaging means.

16. The invention in accordance with claim 15, wherein an elongated slot extends into each section across the hinge means and receives the conduit means.

17. The invention in accordance with claim 16, wherein the coupling means includes a laterally extending flange on the conduit means and the hinge means is permitted to slide along the flange upon actuation of the actuator means whereupon shifting of the actuator means causes transverse movement of the conduit means, with the conduit means adapted to move laterally within the elongated slot during the shifting of the actuator means.

18. A pump actuating system for a container having a pump for dispensing the container contents comprising:

a housing;

conduit means at the outlet of the pump to direct the contents of the container away from the pump;

an actuator means mounted by the housing for actuating the pump from a first pump position at which the container contents are in the pump chamber to a second pump position at which the contents are expelled from the pump chamber and then back to the first pump position at which the contents are drawn into the pump chamber;

the actuator means being shiftable in a direction transverse of the conduit means from a first actuator position at which the pump is at the first pump position to a second actuator position at which the pump is actuated to the second pump position and then back to the first actuator position at which the pump is returned to the first pump position, the actuator means including a coupling means for coupling with the conduit means for causing actuation of the pump upon shifting of the actuating means, a finger actuated toggle having a fixed end fixedly connected to the housing, a distal toggle end having a finger engaging means for shifting the actuator means for actuating the pump and hinge means intermediate the toggle ends for translating the shifting of the finger engaging means into movement of the conduit means through the coupling means that causes actuation of the pump, an elongated slot extending into each section across the hinge means and receives the conduit means.

19. A pump actuating system for a container having a pump for dispensing the container contents comprising:

a housing;

conduit means at the outlet of the pump to direct the contents of the container away from the pump;

an actuator means mounted by the housing for actuating the pump from a first pump position at which the container contents are in the pump chamber to a second pump position at which the contents are expelled from the pump chamber and then back to the first pump position at which the contents are drawn into the pump chamber;

the actuator means being shiftable in a direction transverse of the conduit means from a first actuator position at which the pump is at the first pump position to a second actuator position at which the pump is actuated to the second pump position and then back to the first actuator position at which the pump is returned to the first pump position;

the actuator means including a coupling means for coupling with the conduit means for causing actuation of the pump upon shifting of the actuating means, a finger actuated toggle having a fixed end fixedly connected to the housing, a distal toggle end having a finger engaging means for shifting the actuator means for actuating the pump and hinge means intermediate the toggle ends for translating the shifting of the finger engaging means into movement of the conduit means through the coupling means that causes actuation of the pump, the coupling means including a laterally extending flange on the conduit means and the hinge means is permitted to slide along the flange upon actuation of the actuator means whereupon shifting of the actuator means causes transverse movement of the conduit means.

* * * * *